United States Patent [19]

Nomura et al.

[11] 4,247,595

[45] Jan. 27, 1981

[54] THERMOSENSITIVE RECORDING MATERIAL

[75] Inventors: Minoru Nomura, Mishima; Susumu Iwata, Shizuoka; Mithuo Ono, Gotenba, all of Japan

[73] Assignee: Ricoh Co., Ltd., Tokyo, Japan

[21] Appl. No.: 61,457

[22] Filed: Jul. 27, 1979

[30] Foreign Application Priority Data

Aug. 3, 1978 [JP] Japan ..... 53/94913

[51] Int. Cl.[3] ..... B41M 5/18

[52] U.S. Cl. ..... 428/329; 282/27.5; 427/150; 427/151; 428/331; 428/454; 428/488; 428/913; 428/914

[58] Field of Search ..... 282/27.5; 427/150, 151; 428/307, 411, 537, 913, 914, 328, 329, 331, 454, 484, 488; 106/21

[56] References Cited

U.S. PATENT DOCUMENTS 4,168,845 9/1979 Oeda et al. ..... 428/913 X

*Primary Examiner*—Bruce H. Hess

*Attorney, Agent, or Firm*—Blanchard, Flynn, Thiel, Boutell & Tanis

[57] ABSTRACT

A thermosensitive recording material which is composed of a support and a thermosensitive layer formed thereon, said thermosensitive layer comprising a chromogenic substance, a developing substance and an inorganic filler consisting essentially of hexagonal system thin plate type kaolin, is not only capable of forming an image of high quality but also capable of preventing abrasion of the thermal head.

9 Claims, No Drawings

THERMOSENSITIVE RECORDING MATERIAL

BACKGROUND OF THE INVENTION (a) Field of the Invention

This invention relates to a thermosensitive recording material, and particularly it relates to a thermosensitive recording material comprising as active ingredients a chromogenic substance, a developing substance and an inorganic filler.

(b) Description of the Prior Art

With the recent rapid development of information industries thermosensitive recording materials devised to form a colored recorded image through thermal fusion reaction by means of a thermal head are now used in the printouts of computers, facsimile machines various meters and electronic calculators. These thermosensitive recording materials are generally composed of a paper support and a thermosensitive layer formed thereon, said thermosensitive layer comprising a chromogenic substance which usually consists of colorless or pale-color dye, a developing substance which consists of organic matter such as phenols, a binder, and an inorganic filler such as calcium carbonate, talc, etc. The inorganic filler used herein is for the purpose of improving the whiteness (or opacity), the writability as well as the durability of recording materials.

However, in the conventional thermosensitive recording materials, residues of fused substances are apt to stick to the thermal head at the time of recording to develop the 'sticking phenomenon', resulting in lowering of image density, occurrence of bend, cut, improper thickness or fineness and fog of ground of the recorded image and deterioration of the recording characteristic of recording materials. Also, these thermosensitive recording materials are defective in that they would cause abrasion of the thermal head when the time of their contact with the thermal head is prolonged, entailing lack of distinctness of the resulting image.

SUMMARY OF THE INVENTION

The foregoing defects of the conventional thermosensitive recording materials are ascribable to mismatching between the thermal head and the recording materials. We have therefore made a series of studies with a view to eliminating these defects, and, as a result, we found that addition of a specific inorganic filler to such thermosensitive compositions comprising a chromogenic substance and a developing substance can produce thermosensitive recording materials which prevent sticking of residues to the thermal head at the time of recording and accordingly have the effect of rendering the resulting image free from lowering of image density, bend, cut or fog of ground and minimizing abrasion of the thermal head, not to speak of enhancement of the effects to be brought by said inorganic filler per se, namely, durability, whiteness and writability. The present invention has been accomplished on the basis of this finding.

In other words, the present invention is to provide a thermosensitive recording material which is composed of a support and a thermosensitive layer formed thereon, said layer consisting essentially of a chromogenic substance, a developing substance, a binder and an inorganic filler, in which said inorganic filler comprises hexagonal system thin plate type kaolin.

The chromogenic substance for use in the present invention is usually selected from conventional colorless or pale-color leuco dyes such as triphenylmethane, fluoran, phenothiazine, Auramine, spiropyran, etc. To give concrete examples of useful substances, there are Crystal Violet lactone, Malachite Green lactone, 3,3-bis(p-dimethylphenyl)-6-aminophthalide, 3,3-bis(p-dimethylaminophenyl)-6-p-toluene sulfonamide, 3,3-bis(p-dimethylaminophenyl)-6-chlorophthalide, 3-dimethylamino-6-methoxyfluoran, 3-diethylamino-7-chlorofluoran, 3-diethylamino-6-methyl-7-chlorofluoran, 3-dibutylamino-6-methyl-7-chlorofluoran, 3-dimethylamino-6-methyl-7-phenylaminofluoran, 3-dimethylamino-7-methyl(N-methyl-p-toluidino)fluoran, 3-diethylamino-7-benzyl-aminofluoran, 2-{N-(3'-trifluoromethylphenyl)amino}-6-diethyl-aminofluoran, benzoyl leuco Methylene Blue, 3-methyl-di-$\beta$-naphthospiropyran, benzo-$\beta$-naphthospiropyran, 6'-chloro-8'-methoxy-benzoindolino-pyrylospiran, 6'-bromo-8'-methoxy-benzoindolino-pyrylospiran, 2-[3,6-bis(diethylamino)-9-(o-chloroanilino)xanthil]lactam benzoate, etc., but applicable ones are not limited to the aforecited ones.

The developing substance for use in the present invention is a substance which is supposed to react with the foregoing chromogenic substance and cause it to develop colors. As this developing substance, conventional organic acids such as phenolic compounds are employed. To give concrete examples of applicable substances, there are $\alpha$-naphthol, $\beta$-naphthol, 4-t-octylphenol, 4-phenylphenol, 4-t-butylphenol, 4-hydroxyphenoxide, 4-hydroxyacetophenone, resorcine, hydroxynone, pyrogallol, phloroglucin, phloroglucin carboxylic acid, 4,4'-sec-butylidenediphenol, 2,2-bis(p-hydroxyphenyl)propane, 2,2-bis(p-hydroxyphenyl)butane, 4,4'-cyclohexylidenediphenol, 2,2-bis(2,5-dibromo-4-hydroxyphenyl)propane, 4,4'-isopropylidene-bis(2-t-butylphenol), 2,2-methylene-bis(4-chlorophenol), 4-t-octylcatechol, 2,2'-dihydroxydiphenyl, 2,2'-methylene-bis(4-methyl-6-t-butylphenol), 2,2'-bis(4'-oxyphenyl)propane, 3,5-xylenol, etc.

As applicable binder, there can be cited water-soluble binders such as polyvinyl alcohol, gelatin, gum arabic, starch, hydroxyethyl cellulose, methyl cellulose, polyacrylamide, polyacrylic acid, carboxyethylcellulose, methoxycellulose, etc.

As inorganic filler, hexagonal system thin plate type kaolin is used in the present invention. This hexagonal system thin plate type kaolin has been commercialized by J. M. Huber Corp. under the trademark "HYDRASHEEN". Further, in the present invention, this filler can be applied in combination with other inorganic fillers, and to cite applicable inorganic fillers, there are, for instance, precipitated calcium carbonate, satin white, titanium oxide, clay, aluminum hydroxide, talc, silica, magnesium carbonate, etc., of which precipitated calcium carbonate is preferable for use in combination with hexagonal system thin plate type kaolin from the view point of effective prevention of the sticking of residue and the lowering of image density.

The appropriate mixing ratio of hexagonal system thin plate type kaolin to other inorganic fillers is in the range of 1:0.3–1 or thereabout.

In the present invention, it is possible to use, jointly with the aforedescribed materials, some additives such as a thermosensitivity improving agent (e.g., montan wax, carnauba wax and their modifications, beeswax, paraffin wax, polypropylene wax, polyethylene wax, higher fatty acid amide, condensate of higher fatty acid amide and formaldehyde, and condensate of higher fatty acid and ethylene diamine), wetting agent (e.g., surface active agent), defoaming agent (e.g., silicone), etc. Further, among the foregoing thermosensitivity improving agents, waxes other than the non-petroleum type waxes, to wit, montan wax, carnauba wax and their modifications and beeswax, etc., are capable of not only improving the thermosensitivity of recording material but also enhancing the preventivity thereof with respect to sticking of residue to the thermal head or thermal pen as well as abrasion thereof, and therefore it is preferable to add such non-petroleum type waxes in the present invention. The appropriate amount of a non-petroleum type wax to be added for this purpose is in the range of from 1 to 4 parts by weight or thereabout per 1 part by weight of the chromogenic substance employed.

As applicable higher fatty acid amide, condensate of higher fatty acid amide and formaldehyde and condensate of higher fatty acid and ethylene diamine, there can be cited stearic acid amide, lauric acid amide, palmitic acid amide, oleic acid amide, condensate of stearic acid amide and formaldehyde (such as methylene bis-stearoamide $C_{17}H_{35}CONHCH_2NHCOC_{17}H_{35}$), condensate of stearic acid amide and formaldehyde (such as methylol stearoamide $C_{17}H_{35}CONHCH_2OH$), condensate of palmitic acid amide and formaldehyde (such as methylene-bis-palmitoamide $C_{15}H_{31}CONHCH_2NHCOC_{15}H_{31}$ and methylol palmitoamide $C_{15}H_{31}CONHCH_2OH$), condensate of stearic acid and ethylene diamine (such as ethylene-bis-stearoamide $C_{17}H_{35}CONHCH_2CH_2NHCOC_{17}H_{35}$), etc. But, applicable substances are not limited to the aforecited compounds, providing that their melting point should be in the range of from 80° C. to 150° C.

In order to prepare a thermosensitive recording material according to the present invention, it will do to coat an aqueous dispersion having a composition comprising the aforedescribed chromogenic substance, developing substance, binder and hexagonal system thin plate type kaolin on a support consisting of ordinary paper, synthetic paper, synthetic resin film, etc. and dry it thereafter. The appropriate amount of said dispersion to be coated is in the range of from 4 to 10 g/m$^2$ in dry weight. Preparation of this dispersion is conducted by the use of a disperser such as ball mill, attriter, sand mill, etc. Further, the appropriate amount of the chromogenic substance, developing substance, binder and inorganic filler consisting essentially of hexagonal system thin plate type kaolin to be employed is respectively as follows: the amount of said developing substance is in the range of about from 1 to 5 parts by weight per 1 part by weight of said chromogenic substance; the amount of said filler is in the range of about from 1 to 10 parts by weight per 1 part by weight of said chromogenic substance; and the amount of said binder is in about the range of from 0.1 to 0.5 part by weight per 1 part by weight of the whole composite.

Now, hereunder will be given examples embodying the present invention.

DESCRIPTION OF THE PREFERRED EMBODIMENTS

EXAMPLE 1

Liquid A, liquid B and liquid C having the following compositions, respectively, were pulverized and dispersed separately within a ball mill for 24 hours and thereafter were filtered through a 200-mesh filter. Further, liquid D having the following composition was pulverized and dispersed by means of an attriter for 10 hours and thereafter was filtered through a 200-mesh filter.

| | |
|---|---|
| liquid A: | |
| 3-diethylamino-6-methyl-7-N-phenylaminofluoran | 20 g |
| 10% aqueous solution of polyvinyl alcohol | 20 g |
| water | 60 g |
| liquid B: | |
| Bisphenol A | 28 g |
| 10% aqueous solution of polyvinyl alcohol | 28 g |
| water | 44 g |
| liquid C: | |
| hexagonal system thin plate type kaolin | 30 g |
| 5% aqueous solution of methyl cellulose | 30 g |
| water | 40 g |
| liquid D: | |
| a montan wax modification (S-wax manufactured HO HOCHST Co.) | 220 g |
| 5% aqueous solution of methyl cellulose | 220 g |
| nonionic surface active agent (alkylphenol ethylene oxide adduct) | 11 g |
| water | 559 g |

Subsequently, a thermosensitive liquid was prepared by mixing 30 g of liquid A, 90 g of liquid B, 48 g of liquid C and 40 g of liquid D with 54 g of 20% aqueous solution of polyvinyl alcohol and thereafter adding water to the resulting mixture liquid so as to adjust the viscosity thereof to be 300 cps in order to improve the coatability. Next, by coating this thermo-sensitive liquid on a conventional slick paper weighing about 55 g/cm$^2$ to the extent of 5 to 6 g/m$^2$ in dry weight by means of a wire bar and drying thereafter, there was obtained a thermo-sensitive recording material.

EXAMPLE 2

| | |
|---|---|
| titanium oxide | 30 g |
| 5% aqueous solution of methyl cellulose | 30 g |
| water | 40 g |

A mixture having the above composition was pulverized and dispersed within a ball mill for 24 hours and thereafter was filtered through a 200-mesh filter, whereby liquid E was prepared.

Next, a thermosensitive liquid was prepared by mixing 17 g of the thus prepared liquid E with 30 g of liquid A, 90 g of liquid B, 58 g of liquid C, 40 g of liquid D and 70 g of 20% aqueous solution of polyvinyl alcohol, the same liquids as used in Example 1, and further adding water to the resulting mixture liquid so as to adjust the viscosity thereof to be 300 cps. Subsequently, by employing this thermosensitive liquid and applying the same procedure as that in Example 1, a thermosensitive recording material was prepared.

EXAMPLE 3

| | |
|---|---|
| Crystal Violet lactone | 20 g |
| 10% aqueous solution of polyvinyl alcohol | 20 g |
| water | 60 g |

A mixture having the above composition was pulverized and dispersed within a ball mill for 24 hours and thereafter was filtered through a 200-mesh filter, whereby liquid F was prepared.

Next, a thermosensitive liquid was prepared by mixing 30 g of the thus prepared liquid F with 90 g of liquid B, 30 g of liquid C, 40 g of liquid D, 20 g of liquid E and 54 g of 20% aqueous solution of polyvinyl alcohol, the same liquids as used in Example 1 or 2, and further adding water to the resulting mixture liquid so as to adjust the viscosity thereof to be 300 cps. Subsequently, by employing this thermosensitive liquid and applying the same procedure as that in Example 1, a thermo-sensitive recording material was prepared.

Comparative Example 1.

By mixing 90 g of liquid B, 40 g of liquid D, 50 g of liquid E, 30 g of liquid F, and 54 g of 20% aqueous solution of polyvinyl alcohol, the same liquids as used in Example 1 or 3, and further adding water to the resulting mixture liquid so as to adjust the viscosity thereof to be 300 cps, a thermosensitive liquid was prepared. Subsequently, by applying the same procedure as that in Example 1, a thermosensitive recording material for comparison was prepared.

Comparative Example 2

| | |
|---|---|
| hexagonal system laminate type kaolin ("Caobrite", the manufacture of SHIRAISHI KOGYO K.K.) | 30 g |
| 5% aqueous solution of methyl cellulose | 30 g |
| water | 40 g |

A mixture having the above composition was pulverized and dispersed within a ball mill for 24 hours and thereafter was filtered through a 200-mesh filter, whereby liquid G was prepared.

Next, a thermosensitive liquid was prepared by mixing 48 g of the thus prepared liquid G with 30 g of liquid A, 90 g of liquid B, 40 g of liquid D and 54 g of 20% aqueous solution of polyvinyl alcohol, the same liquids as used in Example 1, and further adding water to the resulting mixture liquid so as to adjust the viscosity thereof to be 300 cps. Subsequently, by applying the same procedure as that in Example 1, a thermosensitive recording material for comparison was prepared.

Comparative Example 3

| | |
|---|---|
| talc | 30 g |
| 5% aqueous solution of methyl cellulose | 30 g |
| water | 40 g |

A mixture having the above composition was pulverized within a ball mill for 24 hours and thereafter was filtered through a 200-mesh filter, whereby liquid H was prepared.

Next, a thermosensitive liquid was prepared by mixing 48 g of the thus prepared liquid H with 30 g of liquid A, 90 g of liquid B, 40 g of liquid D and 54 g of 20% aqueous solution of polyvinyl alcohol, the same liquids as used in Example 1, and further adjusting the viscosity of the resulting mixture liquid to be 300 cps with water. Subsequently, by employing this thermo-sensitive liquid and applying the same procedure as that in Example 1, a thermosensitive recording material for comparison was prepared.

Comparative Example 4.

By mixing 30 g of liquid A, 80 g of liquid B, 48 g of liquid D and 60 g of 20% aqueous solution of polyvinyl alcohol, the same liquids as used in Example 1, and thereafter adding water to the resulting mixture liquid so as to adjust the viscosity thereof to be 300 cps, a thermosensitive liquid was prepared. Subsequently, by applying the same procedure as that in Example 1, a thermosensitive recording material for comparison was prepared.

Each thermosensitive recording material prepared as above was next subjected to the surface treatment through calendaring so as to attain the Beck's smoothness of from 200 to 300 seconds, and was thereafter subjected to the quality evaluation by means of a commercial recorder equipped with an aluminum rod pen as thermal head. The result of said evaluation of the respective recording materials was as shown in Table-1 below. These recording materials were further subjected to image test by means of a serial thermal head provided with 5×7 dot matrix.

EXAMPLE 4

The following liquid A, liquid B' and liquid C' were separately pulverized and dispersed within a ball mill for 24 hours and were thereafter filtered through a 200-mesh filter.

| | |
|---|---|
| composition of liquid A: | |
| The same as that in Example 1. | |
| composition of liquid B': | |
| calcium carbonate | 30 g |
| 5% aqueous solution of methyl cellulose | 30 g |
| water | 40 g |
| composition of liquid C': | |
| hexagonal system thin plate type kaolin | 12 g |
| 5% aqueous solution of methyl cellulose | 12 g |
| water | 36 g |

Further, the following liquid D' and liquid E' were separately pulverized and dispersed by means of an attriter for 10 hours and were thereafter filtered through a 200-mesh filter.

| | |
|---|---|
| composition of liquid D': | |
| montan wax modification | 300 g |
| 5% aqueous solution of methyl cellulose | 300 g |
| nonionic surface active agent | 8 g |
| water | 592 g |
| composition of liquid E': | |
| Bisphenol A | 600 g |
| 10% aqueous solution of polyvinyl alcohol | 600 g |
| water | 800 g |

Subsequently, liquids A, B', C', D' and E' and 20% aqueous solution of polyvinyl alcohol were compounded according to the following prescription:

| | |
|---|---|
| liquid A | 30 g |
| liquid B' | 18 g |
| liquid C' | 60 g |
| liquid D' | 48 g |
| liquid E' | 80 g |
| 20% aqueous solution of polyvinyl alcohol | 100 g |

Next, by diluting the resulting mixture liquid with water to adjust the viscosity thereof to be 300 cps when measured with B-model viscosimeter at a liquid temperature of 25° C. and improve the coatability, a thermosensitive layer forming liquid was prepared.

And then, by coating this thermosensitive layer forming liquid on a commercial slick paper (weighing about 55 g/m$^2$) to the extent of 5 to 6 g/m$^2$ in dry weight by means of a wire bar and drying thereafter, a thermosensitive recording material was prepared.

This thermosensitive recording material was subjected to the surface treatment through calendaring so as to attain the Beck's smoothness of from 200 to 300 seconds and was thereafter subjected to the quality evaluation by means of a recorder equipped with a rod pen as thermal head. The result was as shown in Table-1 below.

In the abrasion test, it was confirmed that the employment of precipitated calcium carbonate as calcium carbonate is preferable as it minimizes abrasion of the head as well as sticking of the residue so that the resulting image is free from cut, bend, improper thickness or fineness of lines of the image, attesting to satisfactory head-matching.

Meanwhile, when this recording material was subjected to image test employing a serial thermal head provided with 5×7 dot matrix, it could produce a distinct image.

TABLE 1

| | | Quality evaluation | | | | | |
|---|---|---|---|---|---|---|---|
| | | | Head-matching property *1 | | | | |
| | Kind of inorganic filler | *2 Abrasion of head | Sticking of residue to thermal head | Cut | Bend | Thickness or fineness | Writability |
| Example 1 | hexagonal system thin plate type kaolin | 1.5 μ | A | A | A | A | A |
| Example 2 | hexagonal system thin plate type kaolin and titanium oxide | 2.2 μ | A | A | A | A | A |
| Example 3 | hexagonal system thin plate type kaolin | 2.4 μ | A | A | A | A | A |
| Comparative Example 1 | titanium oxide | 8.0 μ | A | C | E | E | A |
| Comparative Example 2 | hexagonal system laminate type kaolin | 2.0 μ | D | B | C | B | A |
| Comparative Example 3 | talc | 24.7 μ | E | impossible to evaluate | impossible to evaluate | impossible to evaluate | A |
| Comparative Example 4 | — | 2.9 μ | D | C | C | C | D |
| Example 4 | hexagonal system thin plate type kaolin and calcium carbonate | 2.1 μ | A | A | A | A | A |

(Remarks)
*1: 5-grade(A,B,C,D and E) evaluation method was applied. (A signifies the highest and E the lowest.)
*2: After scanning 360 Km with an aluminum rod pen at the rate of 10 mm/sec., the amount of wear of the tip of said pen (based on the most intensely worn portion) was measured by the use of an optical michroscope.

As is evident from the foregoing results, all the recording materials according to the present invention proved to have the effect that they can minimize abrasion of the tip of pen and sticking of residue to the thermal head, are free from cut, bend, improper thickness as well as fineness of lines of the image, and demonstrate satisfactory head-matching property. Besides, when subjected to image test, all of them could produce a distinct image. On the other hand, as for the recording material in Comparative Example 1, its quality is disputable from the view-point of practical use inasmuch as the abrasion of head was as much as 8.0μ, causing gross cut, thickness or fineness of lines of the image and bend of the image. As for Comparative Example 2, though the abrasion of head was as little as 2.0μ, the resulting image was unsatisfactory because of occurrence of cut and bend therein due to sticking of much residue to the thermal head. As for Comparative Example 3, the abrasion of head was so much as 24.7μ, and the thermal head did not move smoothly and failed to draw the image. As for Comparative Example 4, the abrasion of head was 2.9μ and relatively minor, but due to sticking of much residue to the thermal head, the resulting image showed gross cut, bend, etc., so the quality of this recording material is also disputable. Further, all the foregoing materials for comparison save for Comparative Example 3 could produce but indistinct images when subjected to image test.

What is claimed is:

1. In a thermosensitive recording material comprising a support and a thermosensitive color-developing layer on said support, said thermosensitive color-developing layer comprising chromogenic substance, developing substance reactive with said chromogenic substance to develop a color, binder and inorganic filler, the improvement which comprises: said inorganic filler comprises hexagonal thin plate kaolin.

2. A recording material according to claim 1, in which said chromogenic substance is a colorless or pale colored leuco dye and said developing substance is an organic acid.

3. A recording material according to claim 2, in which said organic acid is a phenolic compound.

4. A recording material according to claim 1, in which the amount of said developing substance and the amount of said inorganic filler are in the range of about from 1 to 5 parts by weight and about from 1 to 10 parts by weight, respectively, per 1 part by weight of said chromogenic substance, and the amount of said binder is in the range of about from 0.1 to 0.5 part by weight per 1 part by weight of the whole composition.

5. A recording material according to claim 1, in which said thermosensitive color-developing layer also contains a non-petroleum wax.

6. A recording material according to claim 5, in which the amount of said non-petroleum wax is in the range of from about 1 to 4 parts by weight per 1 part by weight of said chromogenic substance.

7. A recording material according to claim 1, in which said inorganic filler consists of a mixture of hexagonal thin plate kaolin and one member selected from the group consisting of precipitated calcium carbonate, satin white, titanium oxide, clay, aluminum hydroxide, talc, silica and magnesium carbonate.

8. A recording material according to claim 7, in which the weight ratio of said kaolin to said member is in the range of 1:0.3–1.

9. A recording material according to claim 1, in which said inorganic filler consists of mixture of hexagonal thin plate kaolin and precipitated calcium carbonate.

* * * * *